US007288132B2

(12) United States Patent
Chun et al.

(10) Patent No.: US 7,288,132 B2
(45) **Date of Patent: *Oct. 30, 2007**

(54) ADVANCED EROSION RESISTANT CARBIDE CERMETS WITH SUPERIOR HIGH TEMPERATURE CORROSION RESISTANCE

(75) Inventors: ChangMin Chun, Belle Mead, NJ (US); Narasimha-Rao Venkata Bangaru, Annandale, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/369,614

(22) Filed: Mar. 7, 2006

(65) Prior Publication Data

US 2006/0162492 A1 Jul. 27, 2006

Related U.S. Application Data

(62) Division of application No. 10/829,824, filed on Apr. 22, 2004, now Pat. No. 7,074,253.

(60) Provisional application No. 60/471,790, filed on May 20, 2003.

(51) Int. Cl.
*C22C 29/02* (2006.01)

(52) U.S. Cl. ..... 75/239; 75/235; 75/240; 75/246; 428/545

(58) Field of Classification Search ..... 75/239, 75/240, 246, 235; 428/545
See application file for complete search history.

(56) References Cited

U.S. PATENT DOCUMENTS

| | | | | | |
|---|---|---|---|---|---|
| 3,840,367 | A | * | 10/1974 | Rudy | 51/293 |
| 4,124,737 | A | * | 11/1978 | Wolfla et al. | 428/640 |
| 4,606,767 | A | * | 8/1986 | Nagato | 75/242 |
| 4,615,734 | A | * | 10/1986 | Spriggs | 75/237 |
| 5,358,545 | A | * | 10/1994 | Nagro | 75/236 |
| 5,652,028 | A | * | 7/1997 | Taylor et al. | 427/451 |
| 6,162,276 | A | * | 12/2000 | Berger et al. | 75/252 |

* cited by examiner

*Primary Examiner*—Roy King
*Assistant Examiner*—Ngoclan T. Mai
(74) *Attorney, Agent, or Firm*—Robert A. Miglionni; Ramesh Varadaraj

(57) ABSTRACT

Cermets are provided in which a substantially stoichiometric metal carbide ceramic phase along with a reprecipitated metal carbide phase, represented by the formula $M_xC_y$, is dispersed in a metal binder phase. In $M_xC_y$ M is Cr, Fe, Ni, Co, Si, Ti, Zr, Hf, V, Nb, Ta, Mo or mixtures thereof, x and y are whole or fractional numerical values with x ranging from 1 to 30 and y from 1 to 6. These cermets are particularly useful in protecting surfaces from erosion and corrosion at high temperatures.

14 Claims, 4 Drawing Sheets

ADVANCED EROSION RESISTANT CARBIDE CERMETS WITH SUPERIOR HIGH TEMPERATURE CORROSION RESISTANCE

This application is a divisional application filed under 37 C.F.R. 1.53(*b*) of parent U.S. application Ser. No. 10/829,824, filed on Apr. 22, 2004 now U.S. Pat. No. 7,074,253 the entirety of which is hereby incorporated herein by reference, which claims the benefit of U.S. Provisional application 60/471,790 filed May 20, 2003.

FIELD OF INVENTION

The present invention relates to cermet compositions. More particularly the invention relates to metal carbide containing cermet compositions and their use in high temperature erosion and corrosion applications.

BACKGROUND OF INVENTION

Abrasive and chemically resistant materials find use in many applications where metal surfaces are subjected to substances which would otherwise promote erosion or corrosion of the metal surfaces.

Reactor vessels and transfer lines used in various chemical and petroleum processes are examples of equipment having metal surfaces that often are provided with materials to protect the surfaces against material degradation. Because these vessels and transfer lines are typically used at high temperatures protecting them against degradation is a technological challenge. Currently refractory liners are used to protect metal surfaces exposed at high temperature to erosive or corrosive environments. The life span of these refractory liners, however, is significantly limited by mechanical attrition of the liner, especially when exposed to high velocity particulates, often encountered in petroleum and petrochemical processing. Refractory liners also commonly exhibit cracking and spallation. Thus, there is a need for liner material that is more resistant to erosion and corrosion at high temperatures.

Ceramic metal composites or cermets are known to possess the attributes of the hardeners of ceramics and the fracture toughness of metal but only when used at relatively moderate temperatures, for example, from 25° C. to no more than about 300° C. Tungsten carbide (WC) based cermets, for example, have both hardness and fracture toughness making them useful in high wear applications such as in cutting tools and drill bits cooled with fluids. WC based cermets, however, degrade at sustained high temperatures, greater than about 600° F. (316° C.).

The object of the present invention is to provide new and improved cermet compositions.

Another object of the invention is to provide cermet compositions suitable for use at high temperatures.

Yet another object of the invention is to provide an improved method for protecting metal surfaces against erosion and corrosion under high temperature conditions.

These and other objects will become apparent from the detailed description which follows:

SUMMARY OF INVENTION

Broadly stated the present invention is a cermet composition comprising a ceramic phase, (PQ), dispersed in a binder phase, (RS), and a third phase, G, called a reprecipitated phase, dispersed in (RS). The ceramic phase, (PQ), constitutes about 30 vol % to about 95 vol % of the total volume of the cermet composition, and at least 50 vol % of (PQ) is a carbide of a metal selected from the group consisting of Si, Ti, Zr, Hf, V, Nb, Ta, Mo and mixtures thereof.

The binder phase, (RS), comprises a metal R selected from the group Fe, Ni, Co, Mn and mixtures thereof, and an alloying element S, where based on the total weight of the binder, S comprises at least 12 wt % Cr and up to about 35 wt % of an element selected from the group consisting of Al, Si, Y and mixtures thereof.

The reprecipitated phase, G, comprises about 0.1 vol % to about 10 vol %, based on the total volume of the cermet composition, of a metal carbide represented by the formula $M_xC_y$ where M is Cr, Fe, Ni, Co, Si, Ti, Zr, Hf, V, Nb, Ta, Mo or mixtures thereof, C is carbon, x and y are whole or fractional numerical values with x ranging from about 1 to 30 and y from about 1 to 6.

This and other embodiments of the invention, including where applicable those preferred, will be elucidated in the Detailed Description which follows.

DETAILED DESCRIPTION OF THE INVENTION

Figure 1:
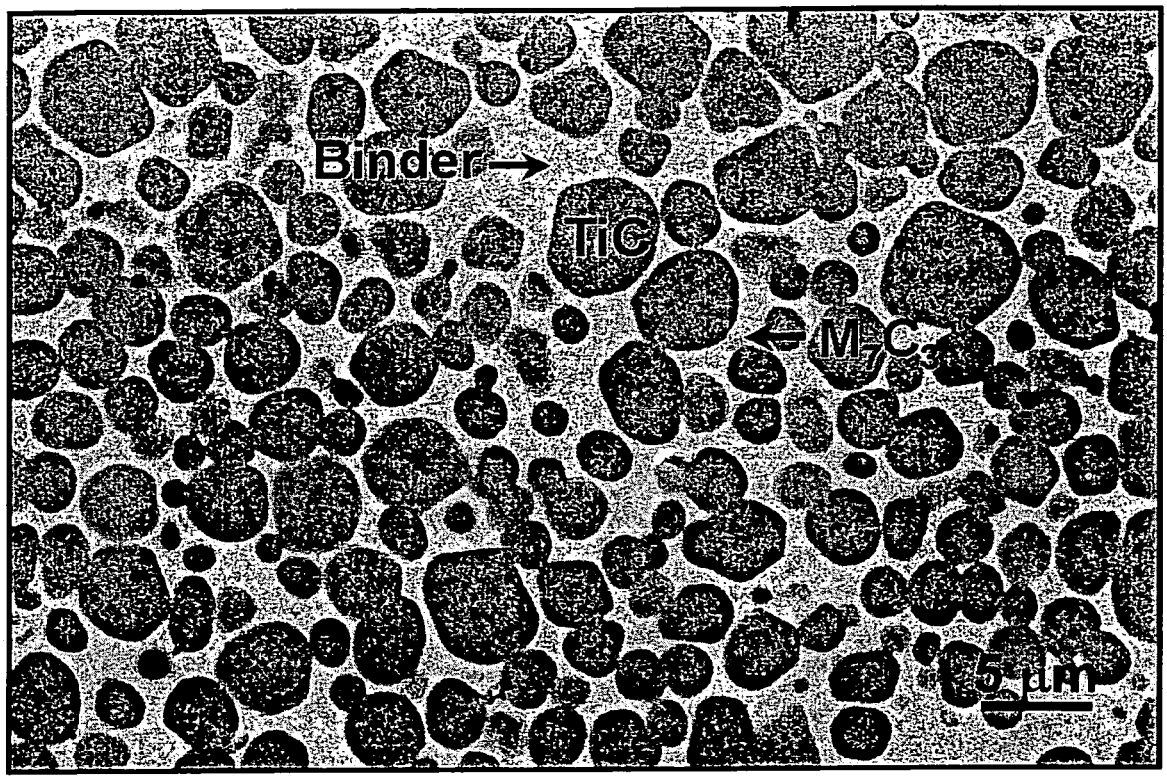
FIG. 1 is a scanning electron microscope (SEM) image of a TiC (titanium carbide) cermet made using 30 vol % 347 stainless steel (347SS) binder illustrating a TiC ceramic phase particles dispersed in the binder and the reprecipitated phase $M_7C_3$ where M comprises Cr, Fe, and Ti.

In one embodiment the invention is a cermet composition that may be represented by the general formula $$(PQ)(RS)G$$

where (PQ) is a ceramic phase dispersed in a continuous, binder phase, (RS), and G is a third phase, called a reprecipitable phase dispersed in (RS).

The ceramic phase (PQ) constitutes about 30 vol % to about 95 vol % of the total volume of the cermet composition. Preferably the ceramic phase constitutes about 65 vol % to about 95 vol % of the cermet composition.

In the ceramic phase, (PQ), P is a metal selected from the group consisting of Group IV, Group V and Group VI elements and mixtures thereof of the Periodic Table of Elements (Merck Index, 20th edition, 1983); Q is selected from the group consisting of carbide, nitride, boride, carbonitride, oxide and mixtures thereof provided, however, that at least 50 vol % of (PQ) is a carbide of a metal selected from the group consisting of Si, Ti, Zr, Hf, V, Nb, Ta, Mo and mixtures thereof. Preferably (PQ) is at least 70 vol % metal carbide and more preferably at least 90 vol % metal carbide. The preferred metal of the metal carbide is Ti.

In the ceramic phase, (PQ), typically P and Q are present in stoichiometric amounts (e.g., TiC); however, minor amounts of (PQ) may have non-stoichiometric ratios of P and Q (e.g., $TiC_{0.9}$).

The particle size diameter of the ceramic phase is typically below about 3 mm, preferably below about 100 μm and more preferably below about 50 μm. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes.

In the binder phase, (RS), of the cermet composition:

R is a metal selected from the group consisting of Fe, Ni, Co, Mn or mixtures thereof, and S is an alloying element where based on the total weight of the binder, S comprises at least 12 wt % Cr, and preferably about 18 wt % to about 35 wt % Cr and from 0 wt % to about 35 wt % of an element selected from the group consisting of Al, Si, Y, and mixtures thereof. The mass ratio of R:S ranges from about 50:50 to about 88:12. The binder phase (RS) will be less than 70 vol %.

Preferably included in the binder, (RS), is from about 0.02 wt % to about 15 wt %, based on the total weight of (RS), of an aliovalent element selected from the group consisting of Ti, Zr, Hf, V, Nb, Ta, Mo, W and mixtures thereof.

Representative examples of iron and nickel based stainless steels, which are the preferred class of binders given in Table 1.

TABLE 1

| Type | Alloy | Composition (wt %) | Manufacturer |
|---|---|---|---|
| Chromia-forming ferritic SS | FeCr | BalFe:26Cr | Alfa Aesar |
| | 446 | BalFe:28Cr | |
| Chromia-forming austenitic SS | 304 | BalFe:18.5Cr:14Ni:2.5Mo | Osprey Metals |
| | M304 | BalFe:18.2Cr:8.7Ni:1.3Mn:0.42Si:0.9Zr:0.4Hf | Osprey Metals |
| | 316 | BalFe:18Cr:10.5Ni:0.97Nb:0.95Mn:0.75Si | Alfa Aesar |
| | 321 | BalFe:18.5Cr:9.6Ni:1.4Mn:0.63Si | Osprey Metals |
| | 347 | BalFe:18.1Cr:10.5Ni:0.97Nb:0.95Mn:0.75Si | Osprey Metals |
| | 253MA | BalFe:21Cr:11Ni:1.7Si:0.8Mn:0.04Ce:0.17N | |
| Chromia-forming FeNiCo-base alloy | Incoloy 800H | BalFe:21Cr:32Ni:0.4Al:0.4Ti | |
| | NiCr | BalNi:20Cr | Alfa Aesar |
| | NiCrSi | BalNi:20.1Cr:2.0Si:0.4Mn:0.09Fe | Osprey Metals |
| | NiCrAlTi | BalNi:15.1Cr:3.7Al:1.3Ti | Osprey Metals |
| | Inconel 601 | BalNi:23Cr:14Fe:1.4Al | |
| | Inconel 625 | BalNi:21.5Cr:9Mo:3.7Nb/Ta | Praxair NI-328 |
| | Inconel 718 | BalNi:19Cr:18Fe:5.1Nb/Ta:3.1Mo:1.0Ti | Praxair NI-328 |
| | Haynes 188 | BalCo:22.4Ni:21.4Cr:14.1W:2.1Fe:1.0Mn:0.46Si | Osprey Metals |
| | Haynes 556 | BalFe:20.5Cr:20.3Ni:17.3Co:2.9Mo:2.5W:0.92Mn:0.45Si:0.47Ta | Osprey Metals |
| | Tribaloy 700 | BalNi:32.5Mo:15.5Cr:3.5Si | Praxair NI-125 |
| Silica forming FeNiCo-base alloy | Haynes 160 | BalNi:28Cr:30Co:3.5Fe:2.75Si:0.5Mn:0.5Ti | |
| Alumina-forming ferritic SS | Kanthal Al | BalFe:22Cr:5Al | |
| | FeCrAlY | BalFe:19.9Cr:5.3Al:0.64Y | Osprey Metals |
| | FeCrAlY | BalFe:29.9Cr:4.9Al:0.6Y:0.4Si | Praxair FE-151 |
| | Incoloy MA956 | BalFe:20Cr:4.5Al:0.5Ti:0.5$Y_2O_3$ | Praxair FE-151 |
| Alumina-forming FeNiCo-base alloy | Haynes 214 | BalNi:16Cr:3Fe:2Co:0.5Mn:0.5Mo:0.2Si:4.5Al:0.5Ti | |
| | FeNiCrAlMn | BalFe:21.7Ni:21.1Cr:5.8Al:3.0Mn:0.87Si | Osprey Metals |
| Alumina-forming inter-metallic | FeAl | BalFe:33.1Al:0.25B | Osprey Metals |
| | NiAl | BalNi:30Al | Alfa Aesar |

In Table 1, "Bal" stands for "as balance". HAYNES® 556™ alloy (Haynes International, Inc., Kokomo, Ind.) is UNS No. R30556 and HAYNES® 188 alloy is UNS No. R30188. INCONEL 625™ (Inco Ltd., Inco Alloys/Special Metals, Toronto, Ontario, Canada) is UNS N06625 and INCONEL 718™ is UNS N07718. TRIBALOY 700™ (E. I. Du Pont De Nemours & Co., DE) can be obtained from Deloro Stellite Company Inc., Goshen, Ind.

The cermet compositions of the invention also include a third phase, called a reprecipitated phase, G. G comprises about 0.1 vol % to about 10 vol %, preferably about 0.1 vol % to about 5 vol % based on the total volume of the cermet composition of a metal carbide represented by the formula $M_xC_y$ where M is Cr, Fe, Ni, Co, Si, Ti, Zr, Hf, V, Nb, Ta, Mo or mixtures thereof, C is carbon, x and y are whole or fractional numerical volumes with x ranging from 1 to 30 and y from 1 to 6. Non-limiting examples include $Cr_7C_3$, $Cr_{23}C_6$, $(CrFeTi)_7C_3$ and $(CrFeTa)_7C_3$.

In one embodiment of the invention the metal carbide of the ceramic phase, (PQ), comprises a core of a carbide of only one metal and a shell of mixed carbides of Nb, Mo and the metal of the core. In this embodiment the preferred metal of the core is Ti.

The composition of the invention may optionally include additional components such as oxide dispersoids, E, and intermetallic dispersoids, F. When present E will be dispersed in (RS) and will constitute about 0.02 wt % to about 5 wt %, based on the binder and is selected from oxides particles of Al, Ti, Nb, Zr, Hf, V, Ta, Cr, Mo, W, Y and mixtures thereof having a diameter of between about 5 nm to about 500 nm. Additionally, E will be dispersed in (RS). When F is present it will be dispersed in (RS) and constitute about 0.02 wt % to about 5 wt % based on the binder of particles having diameters between 1 nm to 400 nm. F will be in the form of a beta, β, or gamma prime, γ', intermetallic compound comprising about 20 wt % to 50 wt % Ni, 0 to 50 wt % Cr, 0.01 wt % to 30 wt % Al, and 0 to 10 wt % Ti.

The volume percent of cermet phase (and cermet components) excludes pore volume due to porosity. The cermet can be characterized by a porosity in the range of 0.1 to 15 vol %. Preferably, the volume of porosity is from 0.1 to less than 10% of the volume of the cermet. The pores comprising the porosity is preferably not connected but distributed in the cermet body as discrete pores. The mean pore size is preferably the same or less than the mean particle size of the ceramic phase (PQ).

Another aspect of the invention is the cermets of the invention have a fracture toughness of greater than about 3 $MPa \cdot m^{1/2}$, preferably greater than about 5 $MPa \cdot m^{1/2}$, and most preferably greater than about 10 $MPa \cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. The (RS) phase of the cermet of the instant invention as described in the earlier paragraphs is primarily responsible for imparting this attribute.

The cermet compositions are made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The green body is then sintered at temperatures above about 1200° C. up to about 1750° C. for times ranging from about 10 minutes to about 4 hours. The sintering operation is preferably performed in an inert atmosphere or a reducing atmosphere or under vacuum. For instance, the inert atmosphere can be argon and the reducing atmosphere can be hydrogen. Thereafter the sintered body is allowed to cool, typically to ambient conditions. The cermet production according to the process described herein allows fabrication of bulk cermet bodies exceeding 5 mm in thickness.

These processing conditions result in the dispersion of (PQ) in the continuous solid phase, (RS), and the formation of G and its dispersion in (RS). Depending upon the chemical composition of the ceramic and binder powders, E and F or both may form during processing. Alternatively dispersoid powder E may be added and milled with the ceramic and binder powders initially.

An important feature of the cermets of the invention is their micro-structural stability, even at elevated temperatures, making them particularly suitable for use in protecting metal surfaces against erosion at temperatures in the range of about 300° C. to about 850° C. It is believed that this stability will permit their use for prolonged time periods under such conditions, for example greater than 2 years. In contrast many known cermets undergo microstructural transformations at elevated temperatures which results in the formation of phases which have a deleterious effect on the properties of the cermet.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, slide valve gates and guides catalyst regenerators, and the like. Thus, metal surfaces exposed to erosive or corrosive environments, especially at about 300° C. to about 850° C. are protected by providing the surface with a layer of the ceramic compositions of the invention. The cermets of the instant invention can be affixed to metal surfaces by mechanical means or by welding.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of weight percent:

The weight percent of elements in the cermet phases was determined by standard EDXS analyses.

The following non-limiting examples are included to further illustrate the invention.

Example 1

70 vol % of 1.1 μm average diameter of TiC powder (99.8% purity, from Japan New Metals Co., Grade TiC-01) and 30 vol % of 6.7 μm average diameter 347 stainless steel powder (Osprey Metals, 95.0% screened below −16 μm) were dispersed with ethanol in high density polyethylene (HDPE) milling jar. The powders in ethanol were mixed for 24 hours with yttria toughened zirconia (YTZ) balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held at about 400° C. for 30 min for residual solvent removal. The disc was then heated to 1450° C. at 15° C./min in argon and held at about 1450° C. for 2 hours. The temperature was then reduced to below 100° C. at −15° C./min.

The resulting cermet comprised:

i) 69 vol % TiC with average grain size of 4 μm ii) 5 vol % $M_7C_3$ with average grain size of 1 μm, where M=66Cr:30Fe:4Ti in wt % iii) 26 vol % Cr-depleted alloy binder (3.0Ti:15.8Cr:70.7Fe:10.5Ni in wt %).

FIG. 1 is a SEM image of the resulting cermet. In this image the TiC phase appears dark and the binder phase appears light. The new $M_7C_3$ type reprecipitated carbide phase is also shown in the binder phase.

Example 2

The procedure of Example 1 was followed using 70 vol % of 1.1 μm average diameter of TiC powder (99.8% purity, from Japan New. Metals Co., Grade TiC-01) and 30 vol % of 15 μm average diameter Inconel 718 powder, 100% screened below −325 mesh (−44 μm).

The resulting cermet comprised:

i) 74 vol % metal ceramic with average grain size of 4 μm, in which 30 vol % is a TiC core and 44 vol % is Nb/Mo/Ti carbide shell, where M=8Nb:4Mo:88Ti in wt % ii) 4 vol % $M_7C_3$ with average grain size of 1 μm, where M=62Cr:30Fe:8Ti in wt % iii) 22 vol % Cr-depleted binder

Figure 2:
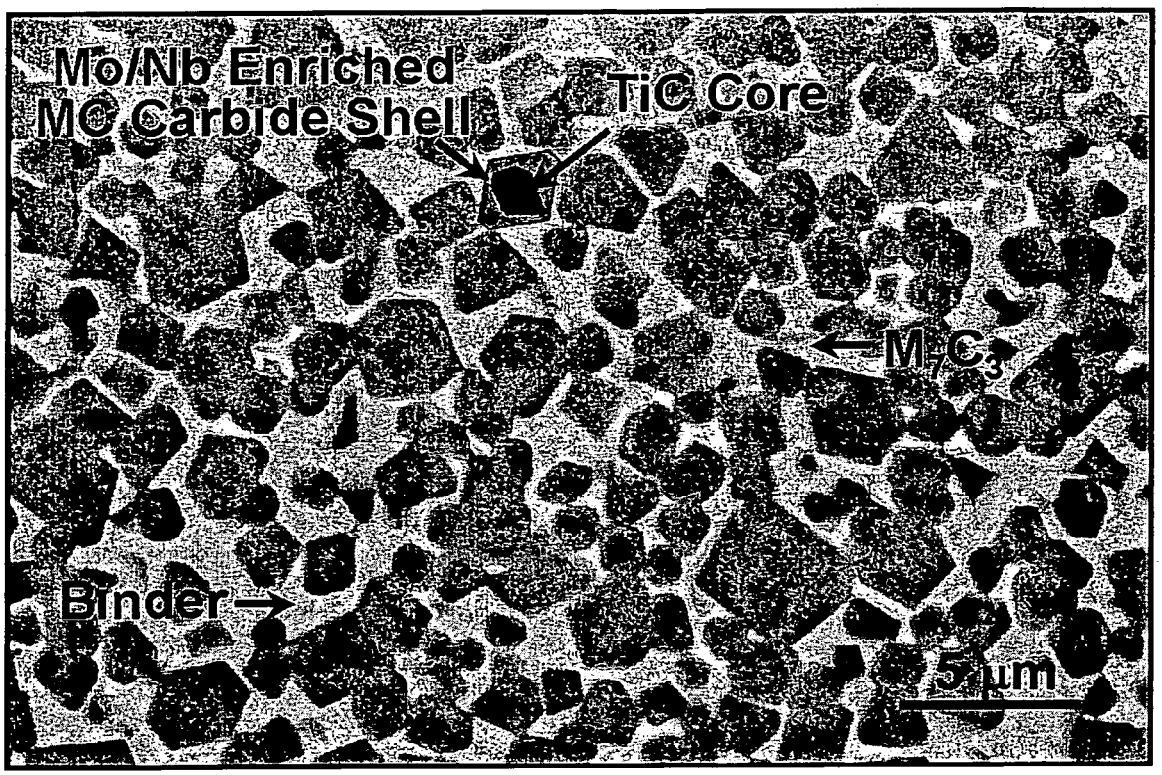
FIG. 2 is a SEM image of a TiC (titanium carbide) cermet made using 30 vol % Inconel 718 alloy binder illustrating TiC ceramic phase particles dispersed in the binder and the reprecipitated phase $M_7C_3$ where M comprises Cr, Fe, and Ti. Also shown in the micrograph is the formation of MC shell around the TiC core.

FIG. 2 shows the TiC core having a Nb/Mo/Ti carbide shell and the $M_7C_3$ reprecipitate phase.

Example 3

The procedure of Example 1 was followed using 70 vol % of 1.1 μm average diameter of TiC powder (99.8% purity, from Japan New Metals Co., Grade TiC-01) and 30 vol % of 15 μm average diameter Inconel 625 powder, 100% screened below −325 mesh (−33 μm).

The resulting cermet comprised:

i) 74 vol % is metal ceramic phase with average grain size of 4 μm, in which 24 vol % is a TiC core and with 50 vol % is Mo/Nb/Ti carbide shell, where M=7Nb:10Mo:83Ti in wt % ii) 4 vol % $M_7C_3$ with average grain size of 1 μm, where M=60Cr:32Fe:8Ti in wt % iii) 22 vol % Cr-depleted alloy binder.

Example 4

The procedure of Example 1 was followed using 70 vol % of 1.1 μm average diameter of TiC powder (99.8% purity, from Japan New Metals Co., Grade TiC-01) and 30 vol % of 6.7 μm average diameter FeCrAlY alloy powder, 95.1% screened below −16 μm.

Figure 3:
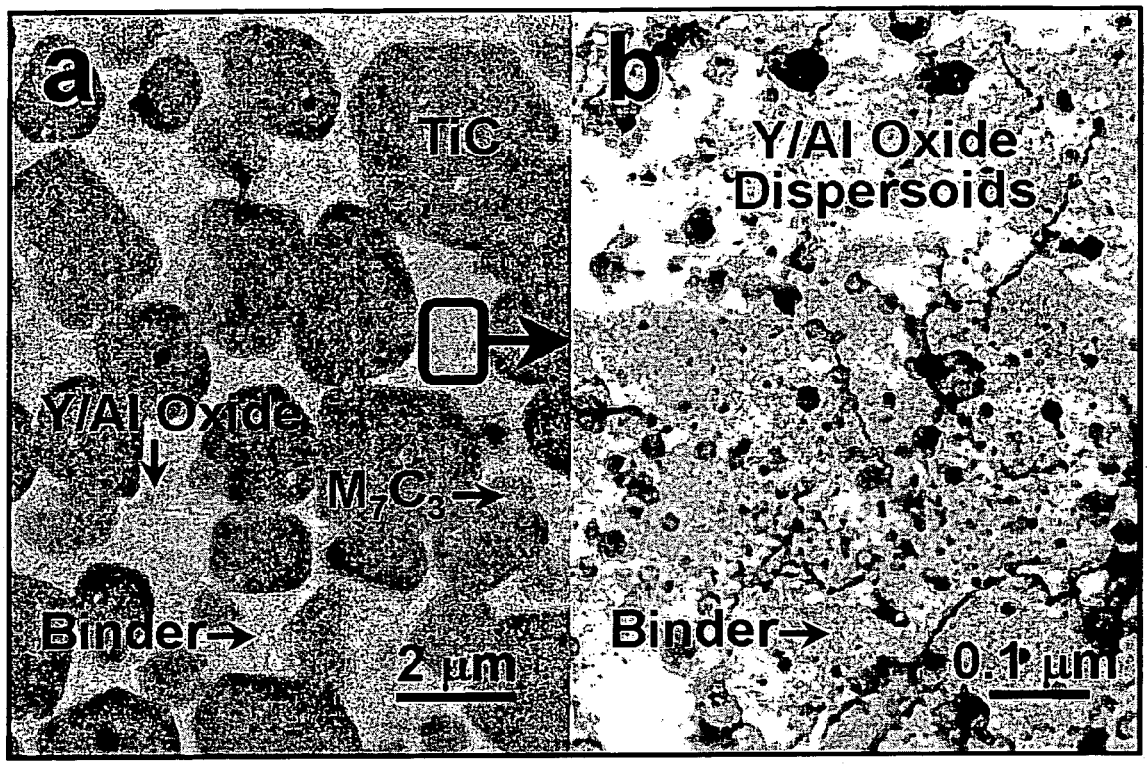
FIG. 3*a* is a SEM image of a TiC (titanium carbide) cermet made using 30 vol % FeCrAlY alloy binder illustrating TiC ceramic phase particles dispersed in the binder, the reprecipitated phase $M_7C_3$ and Y/Al oxide particles.
FIG. 3*b* is a transmission electron microscopy (TEM) image of the same selected binder area as shown in FIG. 3*a* showing Y/Al oxide dispersoids as dark regions.

FIG. 3*a* is a SEM image and FIG. 3*b* is a TEM image of the prepared cermet showing Y/Al oxide dispersoids. The resulting cermet comprised:

i) 68 vol % TiC with average grain size of 4 μm ii) 8 vol % $M_7C_3$ with average grain size of 1 μm, where M=64Cr:30Fe:6Ti in wt % iii) 1 vol % Y/Al oxide dispersoid iv) 23 vol % Cr-depleted alloy binder (3.2Ti:12.5Cr:79.8Fe:4.5 Al in wt %)

Example 5

The procedure of Example 1 again was followed using 85 vol % of 1.1 μm average diameter of TiC powder (99.8% purity, from Japan New Metals Co., Grade TiC-01) and 15 vol % of 6.7 μm average diameter 304SS powder, 95.9% screened below −16 μm.

The resulting cermet comprised:

i) 84 vol % TiC with average grain size of 4 μm ii) 3 vol % $M_7C_3$ with average grain size of 1 μm, where M=64Cr:32Fe:4Ti in wt % iii) 13 vol % Cr-depleted alloy binder (4.7Ti:11.6Cr:72.7Fe:11.0Ni in wt %)

Example 6

Each of the cermets of Examples 1 to 5 was subjected to a hot erosion and attrition test (HEAT) and was found to have an erosion rate less than $1.0\times10^{-6}$ cc/gram of SiC erodant. The procedure employed was as follows:

1) A specimen cermet disk of about 35 mm diameter and about 5 mm thick was weighed.

2) The center of one side of the disk was then subjected to 1200 g/min of SiC particles (220 grit, #1 Grade Black Silicon Carbide, UK abrasives, Northbrook, Il) entrained in heated air exiting from a tube with a 0.5 inch diameter ending at 1 inch from the target at an angle of 45°. The velocity of the SiC was 45.7 n/sec.

3) Step (2) was conducted for 7 hrs at 732° C.

4) After 7 hrs the specimen was allowed to cool to ambient temperature and weighed to determine the weight loss.

5) The erosion of a specimen of a commercially available castable refractory was determined and used as a Reference Standard. The Reference Standard erosion was given a value of 1 and the results for the cermet specimens are compared in Table 2 to the Reference Standard. In Table 2 any value greater than 1 represents an improvement over the Reference Standard.

TABLE 2

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| TiC/347 {1} | 20.0153 | 17.3532 | 2.6621 | 5.800 | 5.04E+5 | 9.1068E−7 | 1.2 |
| TiC/I718 {2} | 19.8637 | 17.7033 | 2.1604 | 5.910 | 5.11E+5 | 7.1508E−7 | 1.5 |
| TiC/I625 {3} | 17.9535 | 16.0583 | 1.8952 | 5.980 | 5.04E+5 | 6.2882E−7 | 1.7 |
| TiC/FeCr AlY {4} | 19.9167 | 18.1939 | 1.7228 | 5.700 | 5.04E+5 | 5.9969E−7 | 1.8 |
| TiC/304 {5} | 19.8475 | 18.4597 | 1.3878 | 5.370 | 5.04E+5 | 5.1277E−7 | 2.0 |

Example 7

77 vol % of TaC powder (99.5% purity, 90% screened below −325 mesh, from Alfa Aesar) and 23 vol % of 6.7 μm average diameter FeCrAlY powder, 95.1% screened below −16 μm, were formed into a cermet following the method of Example 1.

The resulting cermet comprised:

i) 77 vol % TaC with average grain size of 10-20 μm ii) 4 vol % $M_7C_3$ with average grain size of 1-5 μm, where M=Cr,Fe,Ta iii) 19 vol % Cr-depleted alloy binder

Example 8

Each of the cermets of Examples 1, 2, and 3 was subjected to a corrosion test and found to have a corrosion rate less than about $1.0\times10^{-10}$ $g^2/cm^4\cdot s$. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hrs at 800° C.

4) After 65 hrs the specimen was allowed to cool to ambient temperature.

5) Thickness of oxide scale was determined by cross sectional microscopy examination of the corrosion surface.

Figure 4:
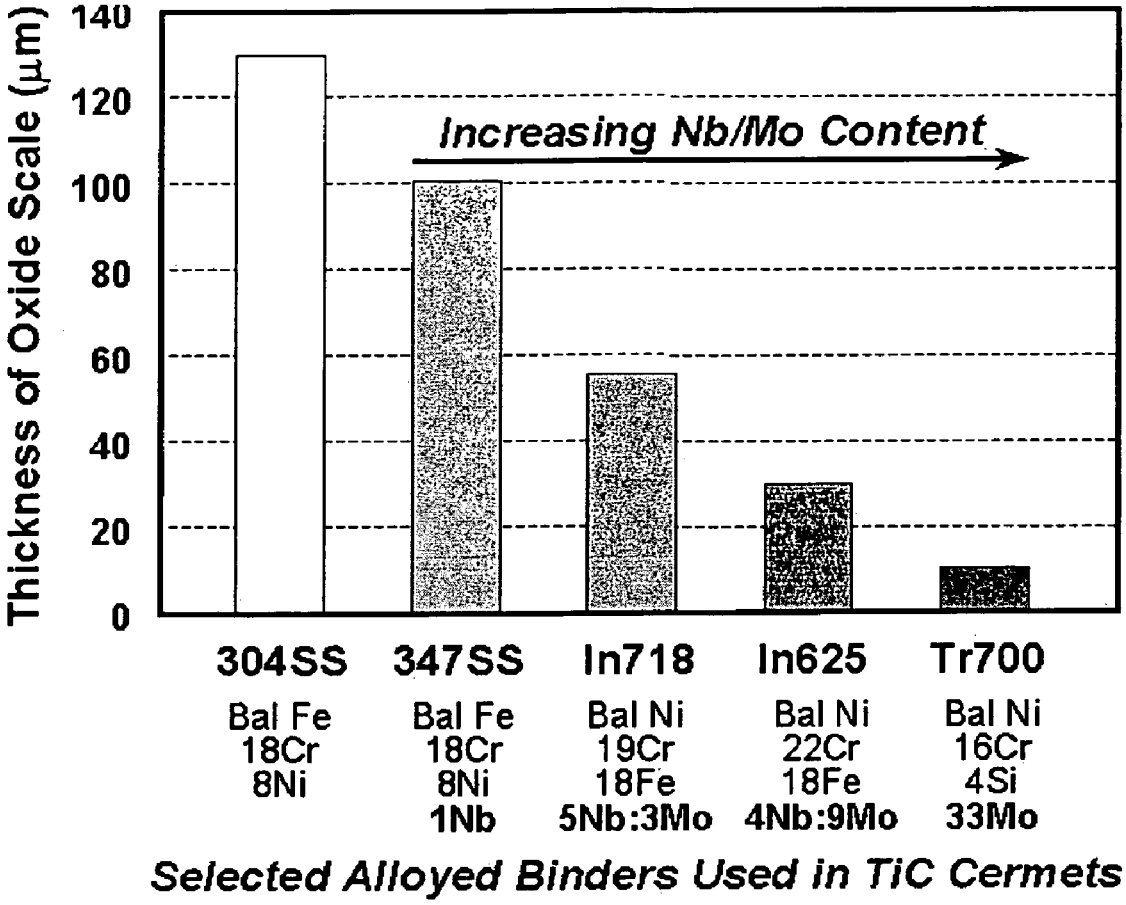
FIG. 4 is a graph showing the thickness (μm) of oxide layer as a measure of oxidation resistance of TiC (titanium carbide) cermets made using 30 vol % binder exposed to air at 800° C. for 65 hours.

6) In FIG. 4 any value less than 150 μm represents acceptable corrosion resistance.

The FIG. 4 showed that thickness of oxide scale formed on TiC cermet surface decreases with increasing Nb/Mo contents of the binder used. The oxidation mechanism of TiC cermet is the growth of $TiO_2$, which is controlled by outward diffusion of interstitial $Ti^{+4}$ ions in $TiO_2$ crystal lattice. When oxidation starts, aliovalent elements, which are present in carbide or metal phases, dissolves substitutionally in $TiO_2$ crystal lattice since the cation size of aliovalent element (e.g., $Nb^{+5}$=0.070 nm) is comparable with that of $Ti^{+4}$ (0.068 nm). Since the substantially dissolved $Nb^{+5}$ ions increase the electron concentration of the $TiO_2$ crystal lattice, the concentration of interstitial $Ti^{+4}$ ions in $TiO_2$ decreases, thereby oxidation is suppressed. This example illustrates beneficial effect of aliovalent elements providing superior oxidation resistance, while retaining erosion resistance at high temperatures.

What is claimed is:

1. A cermet composition represented by the formula (PQ)(RS)FG where (PQ) is a ceramic phase; (RS) is a binder phase; F is an intermetallic dispersoid; and G is reprecipitate phase; and where (PQ), F, and G are dispersed in (RS), the composition comprising:

(a) about 30 vol % to 95 vol % of (PQ) ceramic phase, at least 50 vol % of said ceramic phase is a carbide of a metal selected from the group consisting of Si, Ti, Zr, Hf, V, Nb, Ta, Mo and mixtures thereof, wherein (PQ) comprises particles having a core of a carbide of only one metal and a shell of mixed carbides of Nb, Mo and the metal of the core;

(b) about 0.1 vol % to about 10 vol % of G reprecipitate phase, based on the total volume of the cermet composition, of a metal carbide $M_xC_y$, where M is Cr, Fe, Ni, Co, Si, Ti, Zr, Hf, V, Nb, Ta, Mo or mixtures thereof; C is carbon, and x and y are whole or fractional numerical values with x ranging from 1 to about 30 and y from 1 to about 6;

(c) about 0.02 wt % to about 5 wt % of intermetallic dispersoids, F; and (d) the remainder volume percent comprises a binder phase, (RS), where R is a metal selected from the group consisting of Fe, Ni, Co, Mn and mixtures thereof, and S, based on the total weight of the binder, comprises at least 12 wt % Cr and up to about 35 wt % of an element selected from the group consisting of Al, Si, Y, and mixtures thereof.

2. The composition of claim 1 wherein the intermetallic dispersoids, F comprises:

20 wt % to 50 wt % Ni, 0 wt % to 50 wt % Cr 0.01 wt % to 30 wt % Al; and 0 wt % to 10 wt % Ti.

3. The composition of claim 1 wherein the binder includes about 0.02 wt % to about 15 wt %, based on the weight of a binder phase, (RS), of an aliovalent metal selected from the group consisting of Ti, Zr, Hf, V, Nb, Ta, Mo, W and mixtures thereof.

4. The composition of claim 1 wherein the one metal is Ti.

5. The composition of claim 1 wherein (PQ) is a carbide of Ta.

6. A metal surface provided with a cermet composition according to any one of claims 1, 2, 3, 4, or 5, wherein said metal surface is resistant to effects of exposure to erosive and corrosive environments at temperatures of about 300° C. to about 850° C.

7. The metal surface provided with a cermet composition of claim 6 wherein said metal surface comprises the inner surface of a fluid-solids separation cyclone.

8. A bulk cermet material represented by the formula (PQ)(RS)FG where (PQ) is a ceramic phase; (RS) is a binder phase; F is an intermetallic dispersoid; and G is reprecipitate phase; and where (PQ), F, and G are dispersed in (RS), the composition comprising:

(a) about 30 vol % to 95 vol % of (PQ) ceramic phase, at least 50 vol % of said ceramic phase is a carbide of a metal selected from the group consisting of Si, Ti, Zr, Hf, V, Nb, Ta, Mo and mixtures thereof, wherein (PQ) comprises particles having a core of a carbide of only one metal and a shell of mixed carbides of Nb, Mo and the metal of the core;

(b) about 0.1 vol % to about 10 vol % of G reprecipitate phase, based on the total volume of the cermet composition, of a metal carbide $M_xC_y$ where M is Cr, Fe, Ni, Co, Si, Ti, Zr, Hf, V, Nb, Ta, Mo or mixtures thereof; C is carbon, and x and y are whole or fractional numerical values with x ranging from 1 to about 30 and y from 1 to about 6;

(c) about 0.02 wt % to about 5 wt % of intermetallic dispersoids, F;

(d) the remainder volume percent comprises a binder phase, (RS), where R is a metal selected from the group consisting of Fe, Ni, Co, Mn and mixtures thereof, and S, based on the total weight of the binder, comprises at least 12 wt % Cr and up to about 35 wt % of an element selected from the group consisting of Al, Si, Y, and mixtures thereof; and wherein the overall thickness of the bulk cermet material is greater than 5 millimeters.

9. The bulk cermet material of claim 8 wherein the intermetallic dispersoids, F comprises:

20 wt % to 50 wt % Ni, 0 wt % to 50 wt % Cr 0.01 wt % to 30 wt % Al; and 0 wt % to 10 wt % Ti.

10. The bulk cermet material of claim 8 wherein the binder includes about 0.02 wt % to about 15 wt %, based on the weight of a binder phase, (RS), of an aliovalent metal selected from the group consisting of Ti, Zr, Hf, V, Nb, Ta, Mo, W and mixtures thereof.

11. The bulk cermet material of claim 8 wherein the one metal is Ti.

12. The bulk cermet material of claim 8 wherein (PQ) is a carbide of Ta.

13. A metal surface provided with a bulk cermet material according to any one of claims 8-12, wherein said metal surface is resistant to effects of exposure to erosive and corrosive environments at temperatures of about 300° C. to about 850° C.

14. The metal surface provided with a bulk cermet material of claim 13 wherein said metal surface comprises the inner surface of a fluid-solids separation cyclone.

* * * * *